US009859671B2

(12) United States Patent
Martin

(10) Patent No.: US 9,859,671 B2
(45) Date of Patent: Jan. 2, 2018

(54) CANOPY STRUCTURALLY AND ELECTRICALLY MATING WITH A PLATE FOR ATTACHING AN ELECTRICAL FIXTURE TO AN ELECTRICAL SOURCE

(71) Applicant: Clyde Martin, Atlanta, GA (US)

(72) Inventor: Clyde Martin, Atlanta, GA (US)

( * ) Notice: Subject to any disclaimer, the term of this patent is extended or adjusted under 35 U.S.C. 154(b) by 0 days.

(21) Appl. No.: 15/285,467

(22) Filed: Oct. 4, 2016

(65) Prior Publication Data

US 2017/0025807 A1 Jan. 26, 2017

Related U.S. Application Data

(63) Continuation-in-part of application No. 14/801,971, filed on Jul. 17, 2015, now Pat. No. 9,458,998.

(60) Provisional application No. 62/047,035, filed on Sep. 7, 2014.

(51) Int. Cl.

| | |
|---|---|
| ***H01R 13/62*** | (2006.01) |
| ***H01R 33/97*** | (2006.01) |
| ***H01R 13/73*** | (2006.01) |
| ***F21S 8/04*** | (2006.01) |
| ***F21V 23/06*** | (2006.01) |
| ***H01R 13/625*** | (2006.01) |
| *F21V 33/00* | (2006.01) |

(52) U.S. Cl.

CPC ..... *H01R 33/973* (2013.01); *F21S 8/04* (2013.01); *F21V 23/06* (2013.01); *H01R 13/625* (2013.01); *H01R 13/73* (2013.01); *F21V 33/0088* (2013.01)

(58) Field of Classification Search

CPC .... H01R 13/46; H01R 24/005; H01R 13/443; H01R 13/60; H01R 13/73; H01R 13/74; H01R 13/745; H01R 13/746; H01R 13/625; H01R 33/973; F21S 8/04; F21V 23/06

USPC ..... 439/313, 334, 528, 529, 545

See application file for complete search history.

(56) References Cited

U.S. PATENT DOCUMENTS

| | | | | |
|---|---|---|---|---|
| 1,549,433 | A * | 8/1925 | Benjamin | H02G 3/20 248/224.8 |
| 4,001,574 | A * | 1/1977 | Porter | F21V 21/03 248/327 |
| 4,645,289 | A * | 2/1987 | Isban | H02G 3/20 439/101 |
| 7,249,744 | B2 * | 7/2007 | Bacon | F04D 25/088 248/343 |
| 9,458,998 | B2 * | 10/2016 | Martin | F21S 8/04 |
| 2005/0077446 | A1 * | 4/2005 | Bacon | F04D 29/601 248/343 |
| 2011/0174943 | A1 * | 7/2011 | Smith | B60R 25/00 248/220.21 |
| 2012/0052722 | A1 * | 3/2012 | Smith | H01R 13/625 439/529 |
| 2017/0025807 | A1 * | 1/2017 | Martin | H01R 33/973 |

* cited by examiner

*Primary Examiner* — Chandrika Prasad
(74) *Attorney, Agent, or Firm* — Clayton, McKay & Bailey, PC

(57) ABSTRACT

Described herein is an apparatus for simplifying the connection of an electrical fixture to an electrical source. The system can include a plate element that attaches to an electrical source, such as a junction box. The plate element can mate with a canopy element that is attached to an electrical fixture, such as a light. The plate and canopy can structurally and electrically mate, allowing a user to easily connect various electrical fixtures using the plate and canopy system.

20 Claims, 8 Drawing Sheets

CANOPY STRUCTURALLY AND ELECTRICALLY MATING WITH A PLATE FOR ATTACHING AN ELECTRICAL FIXTURE TO AN ELECTRICAL SOURCE

DESCRIPTION OF THE EMBODIMENTS

Cross Reference to Related Application

This application is a continuation-in-part application of application Ser. No. 14/801,971 (U.S. Pat. No. 9,458,998), filed Jul. 17, 2015, which claims the benefit of priority to provisional application No. 62/047,035 ("Wireless Light Fixture"), filed Sep. 7, 2014, both of which are hereby incorporated by reference in their entireties.

BACKGROUND

The conventional method of installing an electrical fixture and connecting it to a building's power supply is little changed from the advent of ubiquitous electrification. A user installing such a fixture manually attaches the conductors from the building (often, but not always, positive, negative, and ground contained in a junction box) to the corresponding wires in the fixture, covers any bare wire (as with a wire nut or electrical tape) to prevent unwanted shorts, and then affixes the fixture to its structural support.

This process is cumbersome for the average user. For example, it can require the assistance of at least one other person to (among other things) hold the fixture itself while the installer strips, twists together, and safely connects multiple pairs of bare wire ends, and finally mechanically attaches the fixture to the structure. Oftentimes an electrician is brought in by the user to perform this work, whether due to the user's mechanical inability, lack of experience with electrical systems, lack of time, lack of assistance, desire for safety, or need to comply with electrical codes.

The burdens of the conventional method fall on both residential and commercial users. Residential users typically install or change fixtures infrequently, partially due to the complexity and difficulty of the conventional process. Commercial users face the repeated cost of unwiring and rewiring fixtures. This burden may be particularly felt in industries where fixtures are often updated to match changing decor, such as in the hospitality or restaurant industries.

Another set of challenges relates to the placement and allocation of fixtures. Frequently, a given area in a structure will only have a limited number of places at which electrical sources (e.g. junction boxes, outlet boxes, wired mount points, or wire ports) are installed in the ceiling, wall and floor. This limited number of access points must be allocated amongst lighting, control, audiovisual, switching, control, and power applications. The array of different fixture types is broad and can include lights, fans, speakers, televisions, projectors, audiovisual displays, cameras, computing devices, telephones, intercom devices, electrical outlets, switches, sensors, control devices, and combinations thereof.

Even if there are enough total electrical sources to theoretically service a user's desired configuration, the electrical sources in their current configuration may be distributed suboptimally and difficult or impossible to repurpose for a different application (or even a different fixture with the same application). In this case, the user may have to hire an electrician to install new, suitable electrical sources while existing infrastructure goes unused.

In view of at least the above shortcomings, a need exists for a simplified fixture union apparatus.

SUMMARY

Described herein are various embodiments of a simplified electrical fixture union. In one embodiment, a system includes a plate element and a canopy. The plate element is wired to a power source, such as building wiring. The plate element then mates with the distal side of the canopy, which powers and supports an electrical fixture.

The plate element can include an anterior surface and a posterior surface, and a first structural mating element. The plate element can also include a first electrical mating element located on the posterior surface of the plate. In an embodiment, a plate with this arrangement can shield the user from contact with electrical wiring once the plate is installed.

The system can also include a canopy element in an embodiment. The canopy element can include a cavity having a proximal side and a distal side, the distal side shaped to attach to the anterior surface of the plate element. The attaching can include both structural and electrical mating. For example, the canopy element can include a second structural mating element for structurally connecting to the first structural mating element, and a second electrical mating element for electrically connecting to the first electrical mating element on the posterior surface of the plate.

The second structural mating element and second electrical mating element can be provided as part of a protrusion in one embodiment. For example, the plate and the canopy can include a plurality of protrusions that interact to structurally and electrically mate the plate element with the canopy element.

In another embodiment, the structural mating elements of the plate and the canopy can include a locking mechanism for positioning and spatially fixing one or more of the fixture's degrees of freedom.

In another embodiment, the electrical mating elements of the plate and the canopy can carry a plurality of electrical signals.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION

Reference will now be made in detail to exemplary embodiments consistent with the invention, examples of which are illustrated in the accompanying drawings. Wherever possible, the same reference numbers will be used throughout the drawings to refer to the same or like parts.

Figure 1:
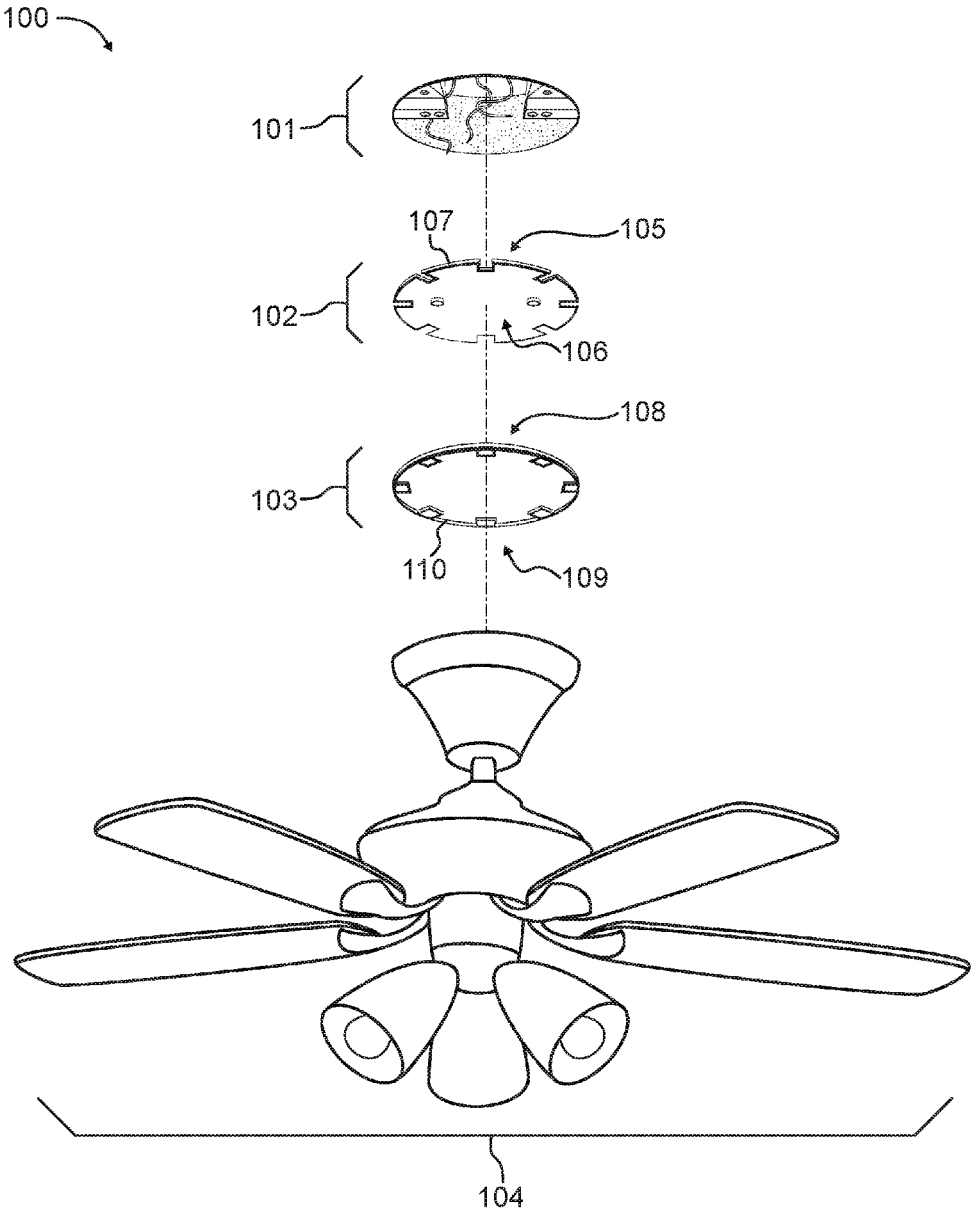
FIG. 1 is an overview of an exemplary electrical fixture union apparatus consistent with one embodiment of the invention.

Referring now to FIG. 1, there is shown an exemplary overview of an electrical fixture union apparatus 100 that includes a plate element 102 and a canopy element 103 in accordance with one embodiment. Plate element 102 and canopy element 103 can also be referred to as a plate and canopy, respectively, for convenience.

In one aspect, the plate 102 is structurally and electrically connected to an electrical source 101. The electrical source 101 can be any electrical connection at a building, such as a residence or commercial building. Example electrical sources 101 include an electrical box (such as a round, rectangular, polygonal, or irregularly shaped junction or outlet box), other wire housing or management configurations, or simply wires themselves. An electrical source 101 may be recessed into or protruding from any surface. In an embodiment, the electrical source 101 may additionally provide a source of digital or analog signals used for the transmission of data or communication.

The plate 102 can be manually connected to wires of the electrical source 101 to shield live wires from user contact. For example, the plate 102 can be attached to contain electrical connections and wires on the posterior side 105 of the plate (e.g., within a junction box). The plate 102 can also be attached in such a way as to provide sufficient structural support for an electrical fixture 104.

Once the plate 102 is in place and electrically connected to the source 101, a user can attach an electrical fixture 104 equipped with a canopy 103 that mates with the plate 102. The mating between the canopy 103 and plate 102 can be both structural and electrical in an embodiment. Example structural connection mechanisms can include brackets, clamps, pins, magnets, or threaded or unthreaded holes for screws or bolts.

The plate 102 can be shaped to attach to common electrical sources 101, such as junction boxes. Some embodiments may, when viewed from above the posterior surface 105 or below the anterior surface 106, have a round or disk-like shape, such that the plate 102 conforms to the size and shape of the mouth of a cylindrical junction box electrical source 101. However, the shape of the plate 102 need not be round. For example, in other embodiments, the plate 102 may have a rectangular, polygonal, or irregular shape.

The plate 102 and canopy 103 can connect together with one or more structural and/or electrical mating elements. For a canopy 103 attached to an electrical fixture 104, this can allow a user to effectively attach the fixture 104 to the source 101 structurally and electrically without using specialized tools in an embodiment.

The structural mating elements can be different components than the electrical mating elements in an embodiment. In another embodiment, the same component may include both a structural and electrical mating element. In an embodiment, the mating elements of the plate 102 and/or canopy 103 may include one or more protrusions. Protrusions, as used herein, can include bumps, ridges, bulges, protuberances, flanges, extensions of material, apertures, notches, incursions, indentations, slots, grooves, voids, or similar components.

In some embodiments, the mating elements of the plate 102 can include one or more protrusions. These protrusions can be on the anterior surface 106, including along the peripheral edge 107. For the purposes of this disclosure, the anterior surface 106 of plate 102 is understood to include the peripheral edge 107. Similarly, protrusions and other features that are said to be on or part of the posterior surface 105 or the anterior surface 106 of the plate 102 may extend to, exist on, or be a feature of, the peripheral edge 107. In some embodiments, protrusions along the peripheral edge 107 of the plate 102 may form a screw thread, flange, or other shape suitable for mating. In some embodiments, the plate 102 may have one or more protrusions along the surface plane such that when viewed from above its posterior surface 105 or below its anterior surface 106, the shape resembles, for example, a notched or slotted disk, a toothed gear, a spiral, a grid, an "X", a keyhole, a dumbbell, etc.

In one embodiment, a plate 102 may be integrated into an electrical source 101 (such as a junction box) and structurally and electrically connected to the electrical source 101 during the manufacturing process. In another embodiment, a plate 102 may be structurally and electrically connected to an electrical source 101 by an end user (such as a contractor, electrician, or homeowner).

The canopy 103 in some embodiments may, when viewed from above the distal side 108, have a round or ring-like shape, such that the canopy 103 conforms to the size and shape of a round-shaped plate 102 with which it is to mate. However, the shape of the canopy 103 need not be round. For example, in other embodiments, the canopy 103 may have a rectangular, polygonal, or irregular shape.

In some embodiments, the mating elements of canopy 103 can include one or more protrusions on the distal side 108 for the canopy 103. For example, when viewed from above its distal side 108, the canopy 103 can resemble a notched or slotted ring or a toothed lock washer.

In some embodiments, the canopy 103 may have one or more protrusions along the interior edge 110 portion of the distal side 108. Generally, protrusions that are said to be on or part of the distal side 108 of the canopy 103 may extend to, exist on, or be a feature of, the interior edge 110. For the purposes of this disclosure, the distal side 108 is understood to include the interior edge 110. In some embodiments, protrusions along the interior edge 110 of the canopy 103 may form a screw thread, flange, or other shape suitable for mating.

In one embodiment, the canopy 103 may be integrated into an electrical fixture 104 and structurally and electrically connected to the electrical fixture 104 during the manufacturing process. In another embodiment, a canopy 103 may be structurally and electrically connected to an electrical fixture 104 by an end user (such as a contractor, electrician, or homeowner).

An electrical fixture 104 may take a variety of forms, including but not limited to a light, a fan, a speaker, a television, a projector, an audiovisual display, a camera, a computing device, a telephone, an intercom device, an electrical outlet, a switch, a sensor, a control device, or a combination thereof. In various embodiments, an electrical fixture 104 may receive AC power, DC power, analog signals, digital signals, or a combination thereof. An embodiment herein can allow a user to easily change out electrical fixtures 104 that connect to or incorporate a canopy 103 anywhere that a matching plate 102 is installed.

When the plate 102 and canopy 103 are electrically mated, then the power from the source 101 can be conducted to the electrical fixture 104. For example, a first electrical mating element on the anterior side of the plate 101 (e.g., within the junction box) can be coupled to a second electrical mating element of the canopy 102 when the canopy 102 and plate 101 are mated. These electrical mating elements may be conductive, and may conduct electricity originating from the source. At least one pair of electrical mating elements can also or alternatively conduct information signals in an embodiment.

In more detail, in one embodiment, mating the plate 102 and canopy 103 can electrically connect the electrical fixture 104 to one or more power sources. Example connections include 2-conductor (positive and negative); 3-conductor (positive, negative, and ground); or other multi-conductor configurations from an electrical source 101 via respective sets (2-conductor, 3-conductor, or other multi-conductor configurations) of conductors in the plate 102 and canopy 103.

In other embodiments, mating the plate 102 and canopy 103 can electrically connect an electrical fixture 104 to one or more analog signal sources. Example signal source include 2-conductor (analog coaxial or unbalanced audio); 3-conductor (balanced audio); 6-conductor (RCA or RJ11); 10-, 12-, or 14-conductor (multichannel); or other multi-conductor configurations) from an electrical source 101 via respective sets of conductors in the plate 102 and canopy 103.

In still other embodiments, an electrical fixture 104 may be electrically connected to one or more digital signal sources. Example signal sources include 2-conductor (digital coaxial); 4- or 5-conductor (USB 2.0); 6-conductor (component video); 8-conductor (Ethernet); 9- or 10-conductor (USB 3.0); 15-conductor (VGA); 19-conductor (HDMI); or other multi-conductor configurations from an electrical source 101 via respective sets of conductors in the plate 102 and canopy 104.

In yet other embodiments, an electrical fixture 104 may be electrically connected to a plurality of power, analog signal, or digital signal sources from an electrical source 101 via respective conductors in the plate 102 and canopy 104. Similar electrical connection mechanisms are well known in the art, as are many alternative configurations, many of which may be used in conjunction with the electrical fixture union apparatus 100 described herein.

Figure 2A:
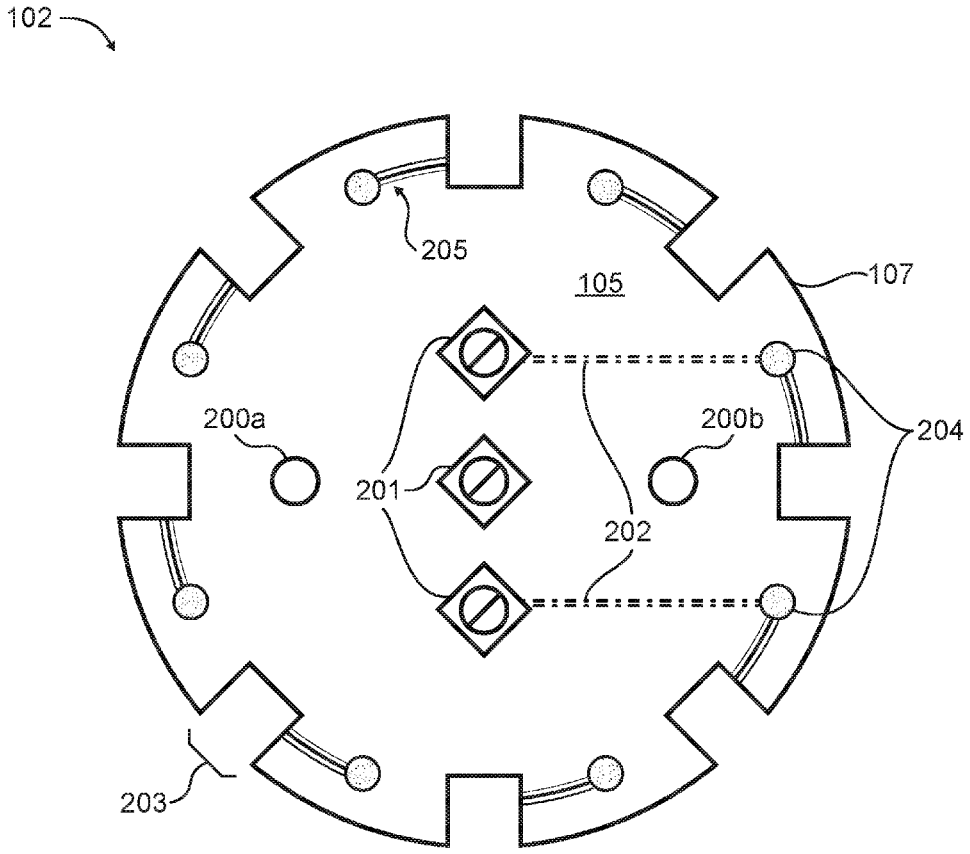
FIG. 2A is a top view of the posterior surface of an exemplary plate element, in accordance with an embodiment.

Referring now to FIG. 2A, there is shown an exemplary top view of the posterior surface 105 of the plate 102 portion of an electrical fixture union apparatus 100 in accordance with one embodiment.

In one aspect, the plate 102 includes one or more structural connection mechanisms 200*a-b* for structurally connecting the plate 102 to an electrical source 101 (e.g., a junction box). In one embodiment, the structural connection mechanisms 200*a-b* for connecting the plate 102 to the electrical source 101 includes one or more holes through the plate 102 (from the anterior surface 106 to the posterior surface 105) or indentations in the peripheral edge 107 of the plate 102 to accommodate connecting the plate 102 to the electrical source 101 via bolts or screws inserted in from the anterior surface 106.

However, the structural connection mechanism 200*a* permits many other embodiments that utilize mounting mechanisms located on the posterior surface 105, peripheral edge 107, or within/through the body of the plate 102. For example, in other embodiments, the structural connection mechanism 200*a* may comprise bolts or screws integral with the plate 102; one or more threaded protrusions that allow the plate 102 to screw into a corresponding threaded receptacle in the electrical source 101 (or vice versa); spring, clamping, or other tension- or compression-based mounting members; brackets or other mounting hardware to affix the electrical fixture union apparatus 100 to structural members other than or proximate to the electrical source 101; or combinations thereof.

The plate 102 can also include one or more electrical connection mechanisms 201 for electrically connecting the posterior surface 105 of the plate 102 to an electrical source 101. In one embodiment, the electrical connection mechanism 201 for connecting the plate 102 to the electrical source 101 includes a plurality of connection points on the posterior surface 105 of the plate 102 for which to attach a plurality of corresponding conductors from the electrical source 101. The connection points of the electrical connection mechanism 201 may take many forms, including, for example, wires extending from the posterior surface 105 of the plate 102; screw posts; binding posts; clips; lugs; latches; spring, spade, or pin terminals; solder points; male or female plug connectors; or combinations thereof. Similar electrical connection mechanisms are well known in the art, as are many alternative configurations, many of which may be used in conjunction with the electrical fixture union apparatus 100 described herein.

The plate 102 can further include a first structural mating element 203 for structurally mating the plate 102 to a canopy 103. The first structural mating element 203 on the plate 102 mates with a corresponding structural mating element on the distal side 108 of the canopy 103. The first structural mating element 203 may be present on the posterior surface 105, anterior surface 106 and/or peripheral edge 107 of the plate 102.

In one embodiment, the first structural mating element 203 may include a plurality of protrusions extending in the radial direction from the peripheral edge 107 of the plate 102, and interface with a plurality of protrusions extending in the radial direction from the interior edge 110 of the canopy 103.

However, the first structural mating element 203 need not necessarily employ such a system, and may instead interface with the distal side 108 of the canopy 103 in the form of one or more matching protrusions and depressions in or on which the distal side 108 of the canopy 103 may rest; a series of grooves or slots that restrict movement; an alternatively configured set of interfacing protrusions; a latch, pin, cuff, spring, tension, screw, clamp, magnetic, or other fastener system; or a combination thereof.

In some embodiments, the first structural mating element 203 may be configured so as to permit mating only in a subset of mating orientations. This can be achieved by, for example, shaping and positioning protrusions on the plate 102 and canopy 103 so they will only interface in certain positions, blocking off certain slots or protrusions so as to prevent interfacing in certain orientations, designing threaded connections with one or a few terminal positions, permitting circumferential motion in only the clockwise or counterclockwise direction, or implementing a pattern of through holes such that the canopy 103 can only be bolted to the plate 102 in certain positions.

The plate 102 may also, in one embodiment, include a locking mechanism 205 used to position and spatially fix one or more degrees of freedom of the fixture 104. In some embodiments, the first structural mating element 203 may be combined with or act as a locking mechanism 205 to fix the electrical fixture 104 in place or restrict its degrees of freedom (e.g. prohibiting all translational movement and prohibiting all but one degree of rotational movement such as pitch or yaw, or prohibiting all rotational movement but allowing translational movement in the x- and y-planes).

In other embodiments, the first structural mating element 203 may be separate from the locking mechanism 205, or the locking mechanism 205 may not be present. In an embodiment that includes a locking mechanism 205 (whether combined with the first structural mating element 203 or not), the locking mechanism 205 may be present on the posterior surface 105, anterior surface 106 and/or peripheral edge 107 of the plate 102.

The plate 102 can further include a first electrical mating element 204 for electrically mating the plate 102 to the canopy 103, and a plate conductor path 202 for electrically connecting the electrical connection mechanism 201 to the electrical mating element 204.

The first electrical mating element 204 on the plate 102 can mate with a corresponding second electrical mating element on the distal side 108 of the canopy 103. The first electrical mating element 204 may be present on the posterior surface 105 and/or peripheral edge 107 of the plate 102. For the purposes of this disclosure, the first electrical mating element 204 being present on the posterior surface 105 or the peripheral edge 107 of the plate 102 can include being present in one or more cavities within the plate 102. For example, the plate 102 can include a slot along an edge 107 such that the mating occurs within the body of the plate 102, which is still a posterior surface relative to the anterior surface 106.

The first electrical mating element 204 may take many forms, such as male or female plug connectors; clips; lugs; latches; spring, spade, or pin terminals; conductive traces; or combinations thereof. Similar electrical connection mechanisms are well known in the art, as are many alternative configurations, many of which may be used in conjunction with the electrical fixture union apparatus 100 described herein.

In one embodiment, a plate conductor path 202 may electrically connect an electrical connection mechanism 201 a first electrical mating element 203. The plate conductor path 202 may be present within the body of the plate 102, or on the posterior surface 105 or peripheral edge 107 of the plate 102. A plate conductor path 202 may connect a plurality of conductors from the electrical connection mechanism 201 to corresponding conductors in the first electrical mating element 203. A plate conductor path 202 can include embedded or surface wiring, conductive traces, various plug connectors and terminals, or combinations thereof.

In one embodiment, the structural connection mechanism 200*a* and the electrical connection mechanism 201 may be combined into a single mechanism for connecting the plate 102 structurally and electrically to the electrical source 101.

In one embodiment, the first structural mating element 203 and the first electrical mating element 204 may be combined into a single mechanism for mating the plate 102 structurally and electrically to the canopy 103. In such an embodiment, the combined mating element may, for example, take the form of matching protrusions and depressions that both structurally fix and electrically connect the plate 102 to the canopy 103 (potentially also acting as a locking mechanism 205 as depicted in FIG. 2A), a conductive threaded attachment mechanism, or conductive fasteners.

In one embodiment, the electrical connection mechanism 201 and the first electrical mating element 204 may be directly connected to each other (this connection thus also comprising the plate conductor path 202). This may occur when conductors from the electrical source 101 are utilized directly in first electrical mating element 203.

Figure 2B:
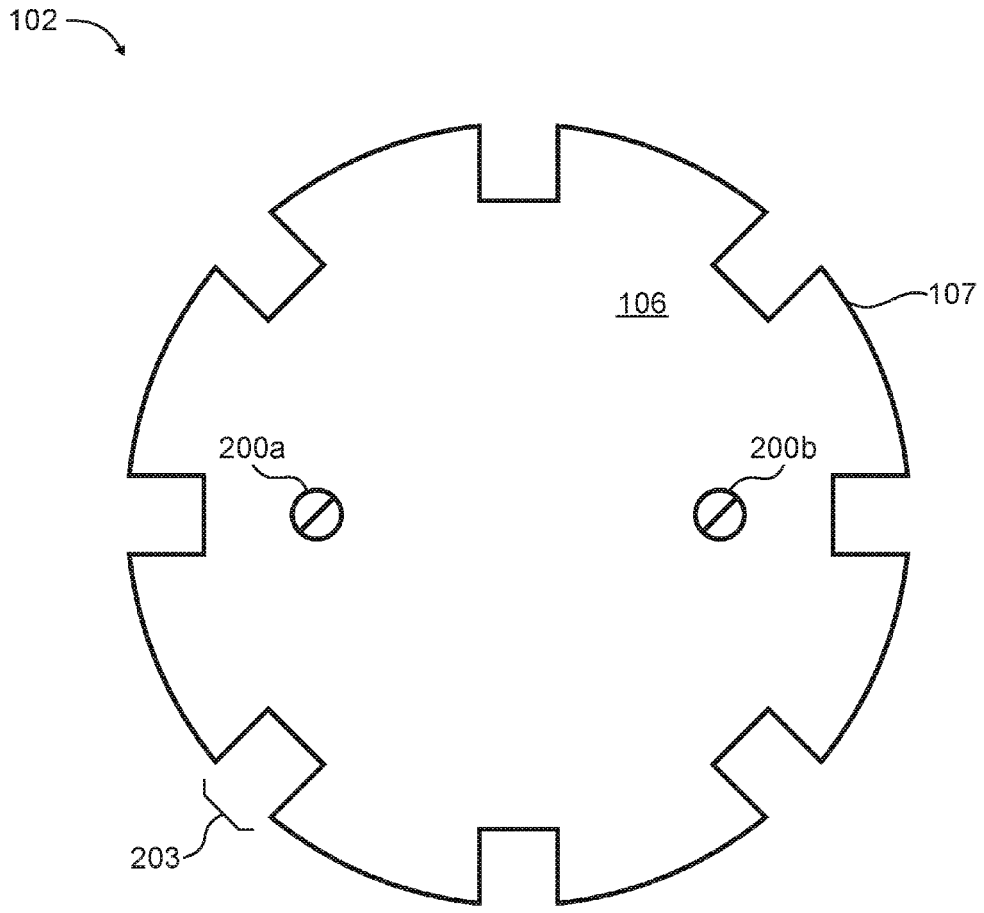
FIG. 2B is a bottom view of the anterior surface of an exemplary plate element, in accordance with an embodiment.

Referring now to FIG. 2B, there is shown an exemplary bottom view of the anterior surface 106 of the plate 102 portion of an electrical fixture union apparatus 100 in accordance with one embodiment.

In one aspect of the embodiment, the anterior surface 106 may (but need not necessarily) include a structural connection mechanism 200*a* for structurally connecting the plate 102 to an electrical source 101, and first structural mating element 203 for structurally mating the plate 102 to a canopy 103. In the process of mating a plate 102 and canopy 103, the anterior surface 106 is the surface closest to and facing the distal side 108 of the canopy 103 as it approaches the plate 102.

Figure 2C:
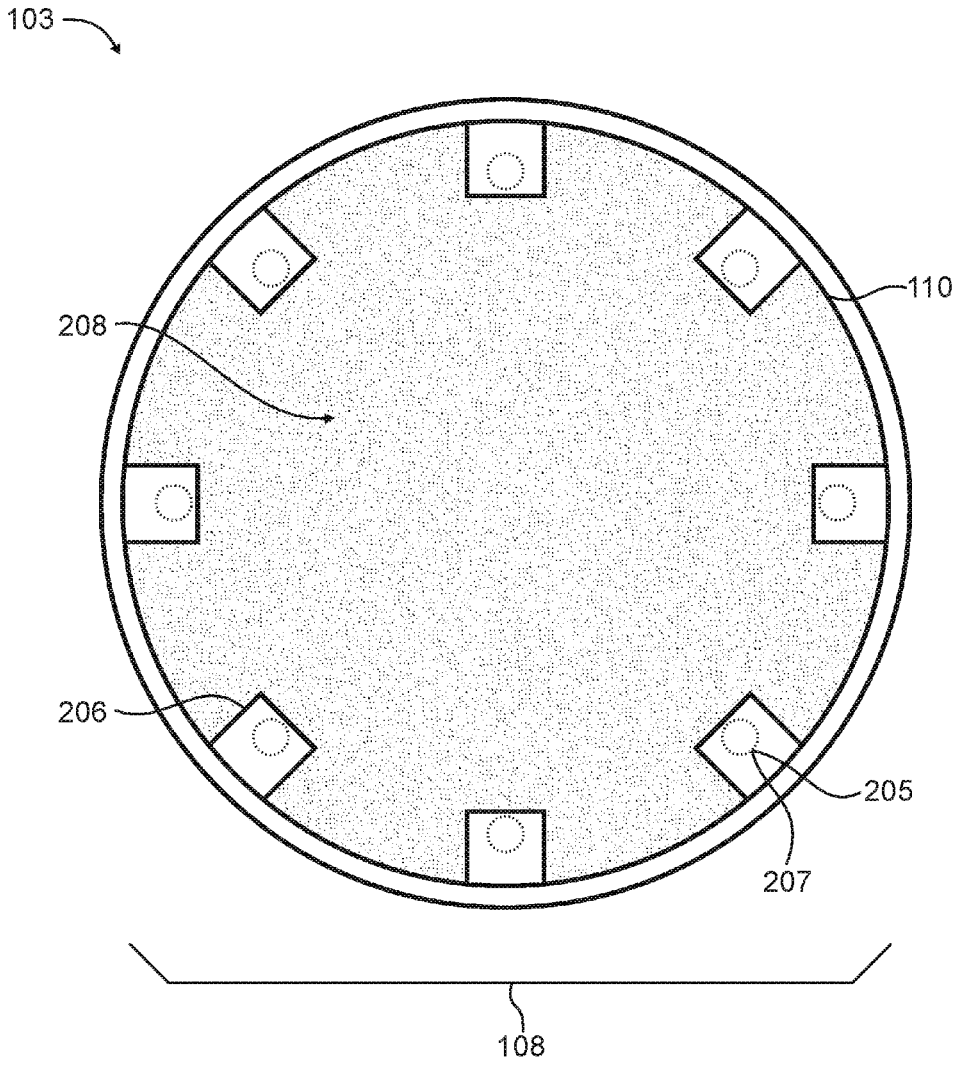
FIG. 2C is a top view of the distal side of an exemplary canopy element of the embodiment depicted in FIG. 1, in accordance with an embodiment.

Referring now to FIG. 2C, there is shown an exemplary top view of the distal side 108 of the canopy 103 portion of an electrical fixture union apparatus 100 in accordance with one embodiment.

In one aspect of the embodiment, the canopy 103 includes a second structural mating element 206 for structurally mating the plate 102 to a canopy 103, a second electrical mating element 207 for electrically mating the plate 102 to the canopy 103, and a cavity 208 permitting the interface of the distal side 108 of the canopy 103 with at least one of the posterior surface 105, anterior surface 106, and peripheral edge 107 of the plate 102.

A cavity 208 may take a variety of forms, in some embodiments being open all the way into the interior of the electrical fixture 104, while in other embodiments being closed and shallow, deep enough only to accommodate the mating of respective structural and electrical mating elements of the plate 102 and canopy 103. In some embodiments, a cavity 208 may be the location of wires or other conductors electrically connecting the canopy 103 to the electrical fixture 104.

The second structural mating element 206 on the canopy 103 mates with a corresponding first structural mating element 203 on the plate 102. The second structural mating element 206 will ordinarily be present on the distal side 108 of the canopy 103. In one embodiment, the second structural mating element 206 may include a plurality of protrusions extending in the radial direction from the interior edge 110 of the canopy 103, and interface with a plurality of protrusions extending in the radial direction from the peripheral edge 107 of the plate 102.

However, the second structural mating element 206 need not employ such a system, and may instead interface with the first structural mating element 203 of the plate 102 in the form of one or more matching protrusions and depressions in or on which the distal side 108 of the canopy 103 may rest (as depicted in the complementary locking mechanism 205 protrusions of FIG. 2A and FIG. 2C); a series of grooves or slots that restrict movement; an alternatively configured set of interfacing protrusions; a latch, pin, cuff, spring, tension, screw, clamp, magnetic, or other fastener system; or a combination thereof. The second structural mating element 206 may, in some embodiments, be configured so as to permit mating only in a subset of mating orientations.

In some embodiments, the second structural mating element 206 may be combined with or act as a locking mechanism 205 to fix the electrical fixture 104 in place or restrict its degrees of freedom. In other embodiments, the second structural mating element 206 may be separate from the locking mechanism 205, or the locking mechanism 205 may not be present. In an embodiment that includes a locking mechanism 205 (whether combined with the second structural mating element 206 or not), the locking mechanism 205 may be present on the distal side 108 (including interior edge 110) of the canopy 103.

The second electrical mating element 207 on the canopy 103 mates with a corresponding first electrical mating element 204 on the plate 102. The second electrical mating element 207 may be present on the on the distal side 108 and/or interior edge 110 of the canopy 103. The second electrical mating element 207 may take many forms, such as male or female plug connectors; clips; lugs; latches; spring, spade, or pin terminals; conductive traces; or combinations thereof. Similar electrical connection mechanisms are well known in the art, as are many alternative configurations, many of which may be used in conjunction with the electrical fixture union apparatus 100 described herein.

In one embodiment, the second structural mating element 206 and the second electrical mating element 207 may be combined into a single mechanism for mating the plate 102 structurally and electrically to the canopy 103.

Figure 3:
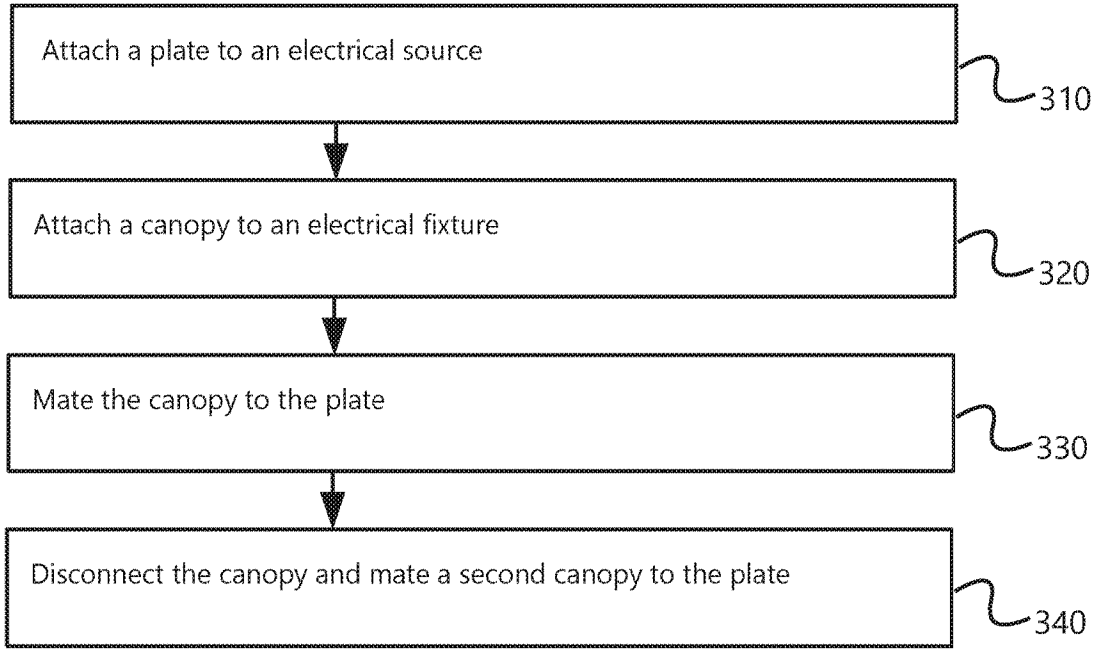
FIG. 3 is an exemplary method for using a simplified electrical union apparatus, in accordance with an embodiment.

FIG. 3 is an exemplary method for using a simplified electrical union apparatus. At step 310, the plate is attached to an electrical source. This can be done, for example, during a house construction process. It can alternatively be done by a user that wishes to transform an ordinary electrical junction box into a box that can interchangeably accept multiple electrical fixtures without rewiring. The wiring can be contained on the posterior side of the plate, shielding the user from shock hazards.

At step 320, the canopy is attached to an electrical fixture. This can be done during manufacturing. Alternatively, the user can install a canopy on an existing electrical fixture to allow for easily moving the fixture between various plate-equipped power sources.

At step 330, the user mounts the canopy onto the plate. This can include inserting one or more protrusions on the canopy into one or more corresponding slots on the plate, or vice versa. In one embodiment, mounting the canopy includes rotating the canopy into place on the plate. A locking mechanism can lock the canopy into place in one example, as described herein. Mounting the canopy can cause the electrical mating elements of the canopy and plate to form a conductive path from the electrical source to the electrical fixture.

For the purposes of this disclosure, mounting a canopy (i.e., canopy element) to the anterior surface of a plate (i.e., plate element) can include protrusions or other locking mechanisms that extend to the posterior side of the plate. For example, protrusions may extend from the distal side of the canopy and slide into place on the posterior surface of the plate. However, this can be done so that the canopy can securely mount on the anterior side of the plate.

Similarly, it is understood that an electrical mating element on the posterior side of the plate can include conductive mating pads that are suspended away from the plate, or that are contained within cavities in the plate. The electrical mating element is still considered to be on the posterior surface for the purposes of this disclosure, because it is located behind the anterior surface of the plate. The anterior surface can thereby act to shield a user from shock. In one embodiment, the anterior surface can act as ground, while at least one electrical mating element (e.g., positive or negative) is located on the posterior side of the plate.

At step 340, the user can un-mount the canopy, and mount a second canopy. In this way, the user can easily switch electrical fixtures without the hassle of additional rewiring. This may allow a user to reconfigure a space for a particular event, then revert to the original configuration after the event has ended.

Figure 4A:
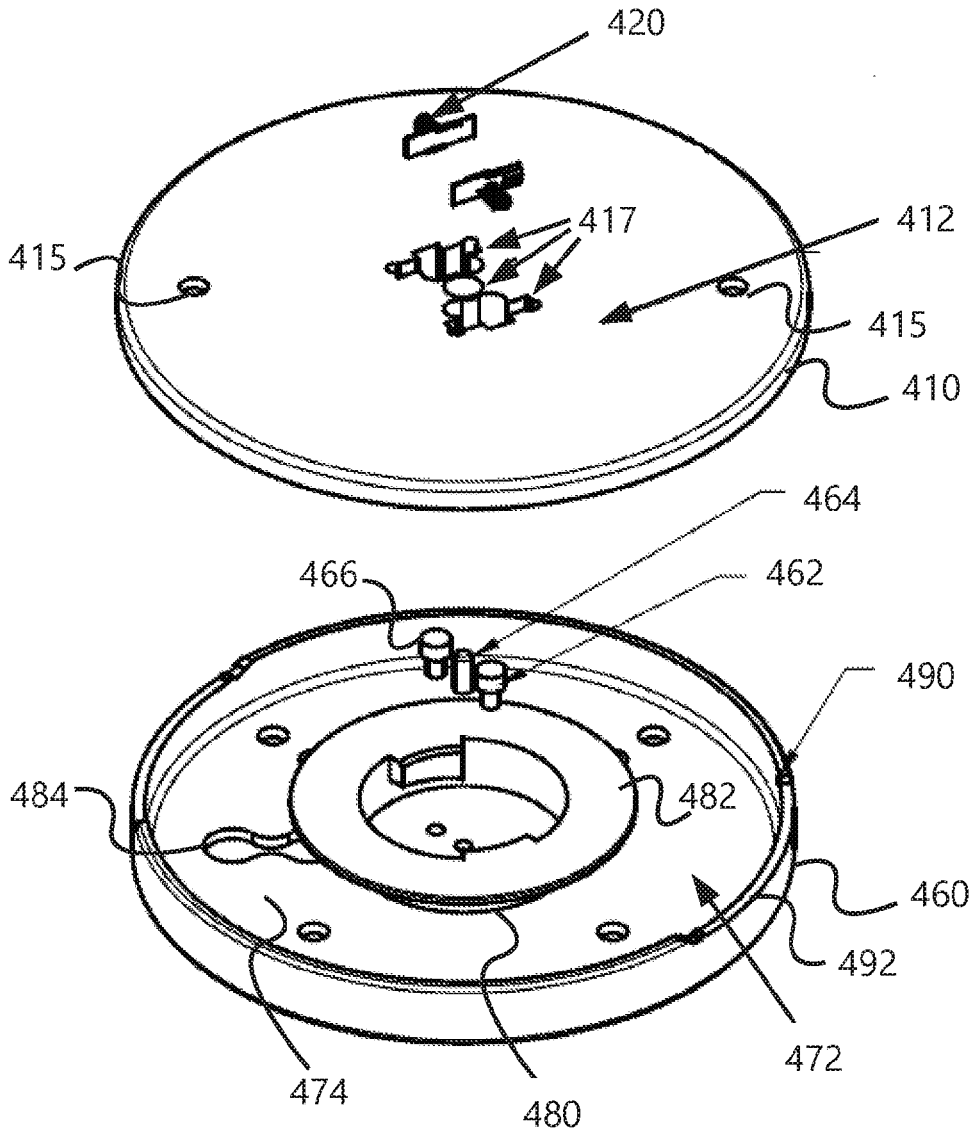
FIG. 4A is a perspective view of the a plate and canopy, in accordance with an embodiment.
Figure 4B:
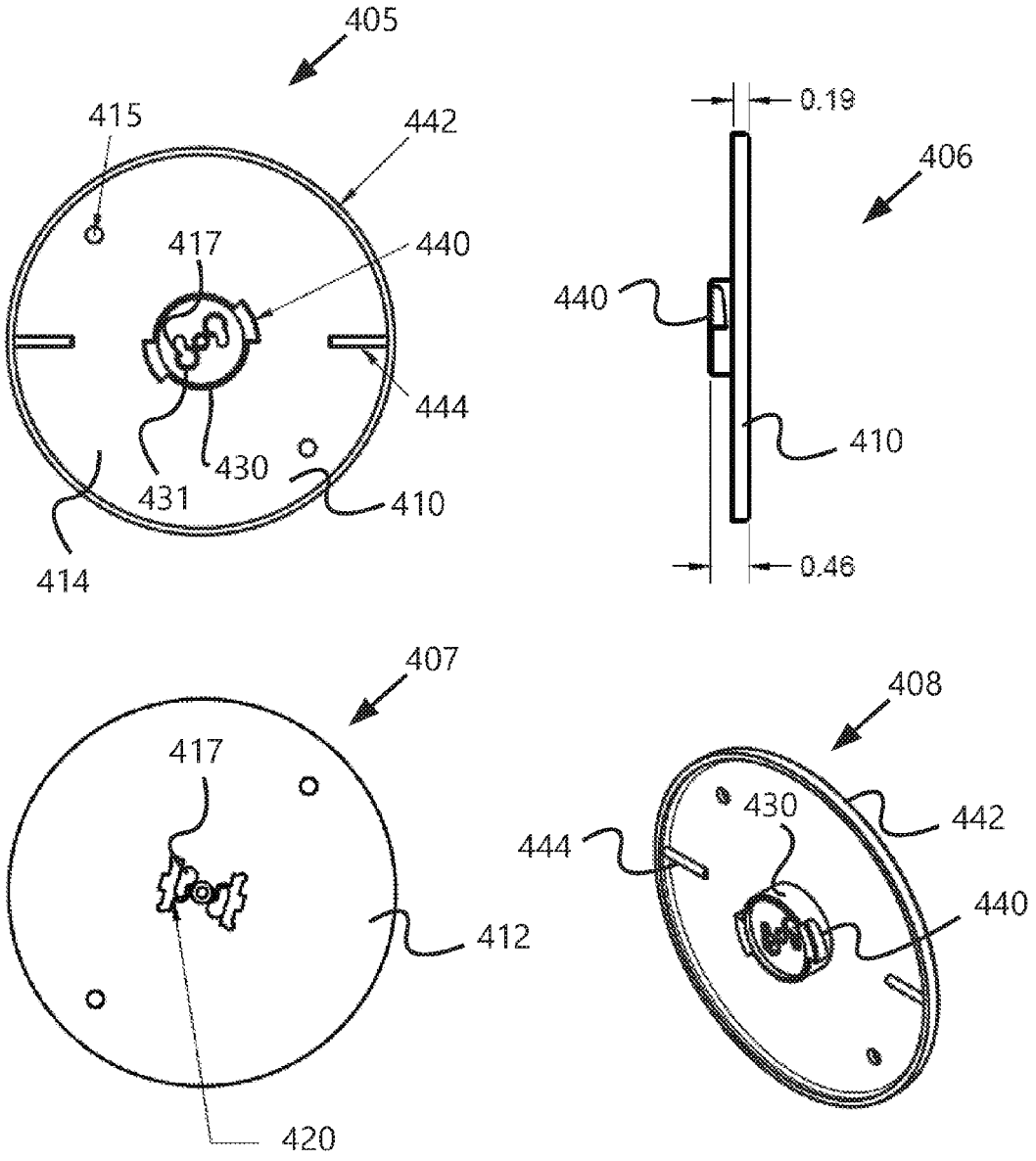
FIG. 4B is multiple example views of a plate or canopy, in accordance with an embodiment.
Figure 4C:
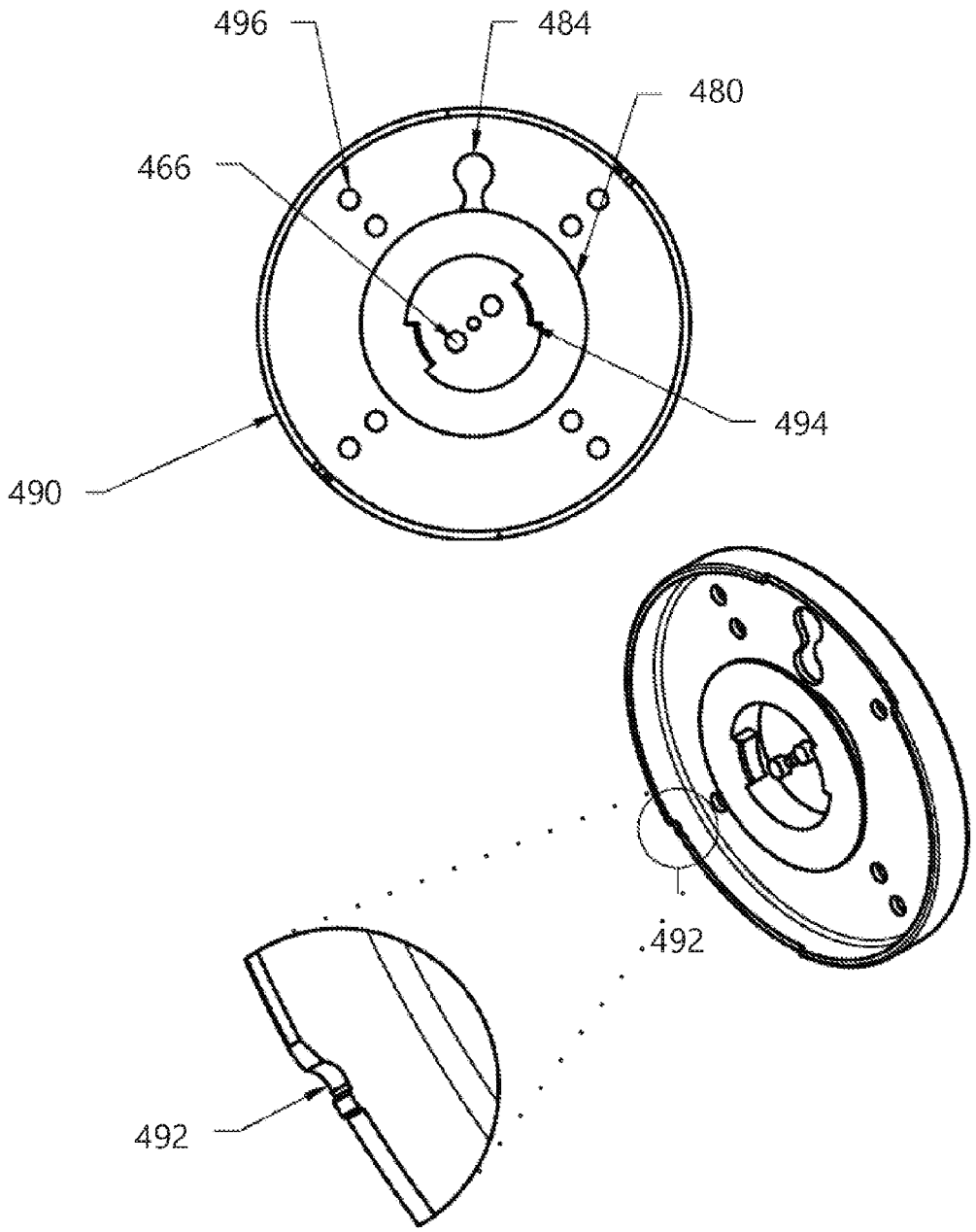
FIG. 4C is multiple example views of a plate or canopy, in accordance with an embodiment.

FIGS. 4A-4C include additional example illustrations of a modular electrical union. FIG. 4A includes a perspective view of a plate 410 and a canopy 460. The plate 410 can attach to an electrical source, such as a junction box. The plate 410 can have slots 417 for accepting pins 462, 464, 466 of the canopy 460. This can allow the canopy to attach to the plate to form both an electrical and structural connection. In another example, the plate 410 and canopy 460 elements can be reversed—that is, element 410 can be the canopy and element 460 can be the plate. Even though plate 410 and canopy 460 are discussed below, the examples discussed can also apply in reverse configuration where the canopy is element 410 and the plate is element 460.

In this illustration, a bottom (anterior) side 412 of the plate 410 is shown. The top side of the plate 410 is not visible in FIG. 4A, but will be discussed below in FIG. 4B. The bottom side 412 can attach to an electrical junction box. Once connected, the bottom side 412 is typically no longer visible since it is attached bottom down onto the junction box. The plate 410 can be attached to a junction box using standard screw holes 415. In one example, an electrical source is first conductively attached to leads 420 that reside on the bottom side 412 next to slots 417. The slots 417 can receive pins from the canopy, forming an electrical connection to the leads 420. In one example, the leads 420 are built into the slots 417. The leads 420 can be spring loaded to ensure connection with the pins 462, 464 within or behind the slots 417.

At least two conductive pins 462, 464 can be used, with at least two corresponding slots 417 on the plate 410. The pins 462, 464 can enter the slots on the top side (not shown) of the plate 410. The pins 462 can contact the leads 420 on the bottom side 412 of the plate 410.

In this example, the plate has three slots 417. The slots can provide access from a front side of the plate to the posterior side 412 of the plate, where an electrical connection is made at the junction box. On the posterior side 412 of the plate, the electrical connection can include connecting neutral, ground, and hot to conductive leads 420 positioned along the slot 417 openings. Ground can be oriented in a middle slot that falls between neutral and hot.

In one example, a canopy 460 can mate with the plate 410 to form both an electrical and structural connection for a fixture. The canopy 460 can be part of the fixture or can be separately attached to the fixture. In one example, the canopy 460 include a proximal side 472 that mates with the top side (not pictured) of the plate 410. The proximal side 472 can have a bass surface 474 from which a cylindrical wall 480 protrudes proximally. The cylindrical wall can have a lip surface 482 that is parallel to the bass surface 474. This can allow the exterior of the cylindrical wall 480 to be used as a cord storage spool. A cord-storage pass-through hole 484 can allow wiring from the fixture to come from the distal side onto the proximal side 472 of the bass surface 474. The wiring can be connected to pins 462 and 464 on either side of the bass surface 474, depending on the example.

The inside of the cylindrical wall 480 or the lip surface 482 can include one or more mating lugs 494. These can be protrusions that gradually vary in width to form a structural connection with locking lugs of the plate (on the top side, not pictured). The mating lugs 494 can alternatively be slots that accept locking lug protrusions of the plate 410.

FIG. 4A shows the pins 462, 464, 466 as floating above canopy 460 for illustration purposes. However, those pins 462, 464, 466 can be seated in the holes shown directly below, on the inside of the raised cylindrical wall 480. The cylindrical wall 480 and lip surface 482 can be taller than the pins 462, 464, 466 to make it difficult to accidentally touch the pins 462, 464, 466 when the canopy A hot pin 462 can include a knob that can fit through a slot 417 but lock into place upon sliding into a narrower portion of the slot 417. A neutral pin 466 can be similarly shaped. A ground pin 464 can be centered in between the hot and neutral pins 462 and 466. In one example, the pins 462, 464, 466 can form a line. The ground pin 464 can be smaller in circumference than the hot and neutral pins 462 and 466. The pins can be oriented to fit into the slots 417 of the plate 410.

The canopy 460 can also include a raised outer wall 490 that mates with the plate 410. The raised outer wall can include on or more female detents 492 that fit over the top of male detents on the top of the plate (not shown).

FIG. 4B includes additional exemplary views 405, 406, 407, 408 of the plate 410. (Alternatively, element 410 can be a canopy when element 460 is the plate.) A top side view 405 looks down at a top side 414 of the plate 410. A raised cylindrical portion 430 on the top side 410 can have a proximal face 431 where the slots 417 are located. The slots 417 on the raised proximal face 431 can receive the conductive pins 462, 464, or 466. The pins can pass through the proximal face 431 and contact conductors 420 on the other side. For example, a bottom view 407 of the bottom side 412 of the plate 410 shows the conductors 420 next to the slots 417. The conductors 420 to the slots 417 connect with the electrical source behind the proximal face such that the proximal face shields the connection. In one example, the knobs of pins 462 and 466 can lock into place within the slots 417 behind the proximal face 431.

The raised cylindrical portion 430 can include one or more locking lugs 440 that mate with the plate. The locking lugs 440 can be positioned on the side of the raised cylindrical portion 430, as illustrated in the side view 406 and the perspective view 408. The locking lugs 440 can increase gradually in thickness to tighten a physical connection with mating lugs 494.

The raised cylindrical wall 480 of the plate 410 (as shown in FIG. 4A) can fit over the raised cylindrical portion 430 in one example. The raised cylindrical wall 480 can have a first mating lug 494 inside the cylindrical wall that mates with the first locking lug 440 on the side of the raised cylindrical portion 431. The raised cylindrical portion 430 can be between 0.25 and 0.5 inches tall in an example.

The plate 410 can include one or more male detents 444 on the top side 414. The male detents can be on opposite sides of the raised cylinder 430 from one another. Alternatively they can be assymetrically offset from one another. The spacing of the male detents 444 can be used to guide the attachment of a canopy 460 to the plate 410.

Additionally, an outer wall 442 of the plate 410 can be raised on the top side 414. In one example, the plate's 410 raised outer wall 442 fits around the canopy's raised outer wall 490 (or vice versa) to form a seal. The canopy's raised outer wall 490 can include one or more female detents 492 that that fit over the top of the plate's 410 male detents 444. The raised outer wall 442 can be between 0.17 and 0.20 inches tall in an example.

Additional views of the canopy 410 are shown in FIG. 4C. As previously stated, the canopy 410 and plate 460 can swap roles in an example. If element 460 is the plate, universal mounting holes 496 can connect the plate 460 to an electrical junction box. An electrical connection, such as a wire carrying 120 VAC can be fed through the pass through hole 484, wrapped around the cord storage spool of the cylindrical wall 480, and connected to the pins 462, 464, and 468. To reduce danger of an exposed hot pin 462, the pins 462, 464, and 468 can be seated within the cylindrical wall 480, lower than the lip 482.

Continuing with this example, element 410 (from FIG. 4A) can be a canopy. The canopy can be attached to a fixture using mounting holes 415. It can then be pressed into the plate such that the raised cylindrical portion 430 slides inside the cylindrical wall 480. The pins 462, 464, and 468 can enter the slots 417.

Twisting the canopy can cause the knobs of the pins 462 and 468 to lock into the slots, causing contact with the conductors 420, which can be spring-loaded. The male detents 444 and female detents 492 can align. A pair of female detents 492 can fit on top of male detents 444 such that the raised outer wall rests within the circular exterior edge of the plate. Additionally, the mating lugs and locking lugs 440 can tighten on one another. In this way, by inserting and twisting the canopy 410 or 460 into the plate 460 or 410, the electrical connection can be made.

In one example, this can allow for the modular deployment of fixtures without the need for tools or electricians.

Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the invention being indicated by the following claims.

What is claimed is:

1. A modular electrical union system, the system comprising:

a plate that connects to an electrical source on a bottom side, the plate including:

a raised cylindrical portion on a top side, the raised cylindrical portion having a proximal face with slots for receiving at least two conductive pins, wherein conductors that are accessible through the slots connect with the electrical source at a connection location behind the proximal face such that the proximal face shields the connection location; and a first locking lug on a side of the raised cylindrical portion; and a canopy that attaches to the plate, the canopy including:

a bass surface;

a raised cylindrical wall that fits over the raised cylindrical portion, the raised cylindrical wall having a first mating lug inside the cylindrical wall that mates with the first locking lug on the side of the raised cylindrical portion; and the at least two conductive pins on the inside of the raised cylindrical wall that mate with the slots.

2. The modular electrical union system of claim 1, wherein the at least two conductive pins includes a ground pin, a hot pin, and a neutral pin, and wherein the ground pin mates with a first slot that is circular and located at a center point of the proximal face of the raised cylindrical portion.

3. The modular electrical union system of claim 2, wherein the plate includes a circular exterior edge, and the raised cylindrical portion is centered within the circular exterior edge.

4. The modular electrical union system of claim 2, wherein the ground pin is smaller in circumference than the hot and neutral pins, and wherein the hot and neutral pins include knobs that lock into place within the slots behind the proximal face.

5. The modular electrical union system of claim 1, wherein the plate includes a pair of male detents on the top side, the male detents being on opposite sides of the raised cylindrical portion from one another, and wherein the canopy includes a raised outer wall that has a pair of female detents that fit over the top of the male detents.

6. The modular electrical union system of claim 5, wherein the pair of female detents fit on top of male detents such that the raised outer wall rests within a circular exterior edge of the plate.

7. The modular electrical union system of claim 1, wherein the first mating lug and first locking lug are shaped such that the canopy is forced into place against the plate by rotating the first mating lug and first locking lug together.

8. The modular electrical union system of claim 1, including:

a second mating lug on an opposite inside portion of the cylindrical wall from the first mating lug; and a second locking lug on an opposite side of the raised cylindrical portion from the first locking lug.

9. The modular electrical union system of claim 1, further including a cord storage pass through hole in the bass surface.

10. The modular electrical union system of claim 1, wherein the raised cylindrical wall is part of cord storage spool, wherein the cord storage spool has a flat lip that is parallel to the bass surface.

11. A modular electrical union system, the system comprising:

a canopy including:

a raised cylindrical portion on a top side, the raised cylindrical portion having a proximal face with slots for receiving at least two conductive pins, wherein conductors that are accessible through the slots connect with the electrical source at a connection location behind the proximal face such that the proximal face shields the connection location; and a first locking lug on a side of the raised cylindrical portion; and a plate that connects to an electrical source on a bottom side, and attaches to the canopy on the top side, the plate including:

a bass surface;

a raised cylindrical wall that fits over the raised cylindrical portion, the raised cylindrical wall having a first mating lug inside the cylindrical wall that mates with the first locking lug on the side of the raised cylindrical portion; and the at least two conductive pins on the inside of the raised cylindrical wall that mate with the slots.

12. The modular electrical union system of claim 11, wherein the at least two conductive pins includes a ground pin, a hot pin, and a neutral pin, and wherein the slots for the hot and neutral pins include spring-pressured conductors and the ground pin lies in a line between the hot and neutral pins.

13. The modular electrical union system of claim 12, wherein the canopy includes a circular exterior edge, and the raised cylindrical portion is centered within the circular exterior edge.

14. The modular electrical union system of claim 12, wherein the ground pin is smaller in circumference than the hot and neutral pins, and wherein the hot and neutral pins include knobs that lock into place within the slots behind the proximal face.

15. The modular electrical union system of claim 11, wherein the canopy includes a pair of male detents on the top side, the male detents being on opposite sides of the raised cylinder from one another, and wherein the plate includes a raised outer wall that has a pair of female detents that fit over the top of the male detents.

16. The modular electrical union system of claim 15, wherein the pair of female detents fit on top of male detents such that the raised outer wall rests within a circular exterior edge of the canopy.

17. The modular electrical union system of claim 11, wherein the first slot and first locking lug are shaped such that the plate is forced into place against the canopy by rotating the first slot and first locking lug together.

18. The modular electrical union system of claim 11, including:

a second slot on an opposite inside portion of the cylindrical wall from the first slot; and a second locking lug on an opposite side of the raised cylindrical portion from the first locking lug.

19. The modular electrical union system of claim 11, further including a cord storage pass through hole in the bass surface.

20. The modular electrical union system of claim 11, wherein the raised cylindrical wall is part of cord storage spool, wherein the cord storage spool has a flat lip that is parallel to the bass surface.

* * * * *